US006481811B1

(12) United States Patent
Marsh

(10) Patent No.: US 6,481,811 B1
(45) Date of Patent: Nov. 19, 2002

(54) FURNITURE CLIP

(75) Inventor: Thomas R. Marsh, High Point, NC (US)

(73) Assignee: Tenn-Tex Platics, Inc., Colfax, NC (US)

( * ) Notice: Subject to any disclaimer, the term of this patent is extended or adjusted under 35 U.S.C. 154(b) by 0 days.

(21) Appl. No.: 09/650,514

(22) Filed: Aug. 29, 2000

(51) Int. Cl.[7] ..... A47B 95/00
(52) U.S. Cl. ..... 312/333; 24/3.12; 292/87
(58) Field of Search ..... 312/333, 330.1, 312/348.1, 348.4; 24/545, 3.12, 563, 541; 292/80, 87, 102, 107, 128, 290

(56) References Cited

U.S. PATENT DOCUMENTS

| | | | | | |
|---|---|---|---|---|---|
| 3,437,365 | A | * | 4/1969 | Zadanoff et al. | 312/333 X |
| 4,416,477 | A | * | 11/1983 | Bialobrzeski et al. | 292/87 X |
| 4,623,177 | A | * | 11/1986 | McKinney | 292/87 |
| 5,619,774 | A | * | 4/1997 | Perry | 24/3.12 X |
| 5,640,742 | A | * | 6/1997 | White et al. | 24/3.12 |
| 5,868,478 | A | * | 2/1999 | Yemini | 312/333 X |
| 5,913,618 | A | * | 6/1999 | Yosha | 24/3.12 X |

OTHER PUBLICATIONS

Tenn–Tex Plastics Inc.; "Injection–Molded Plastics" (Booklet), No date given.

* cited by examiner

*Primary Examiner*—James O. Hansen
(74) *Attorney, Agent, or Firm*—Myers Bigel Sibley & Sajovec

(57) ABSTRACT

A furniture clip includes a mounting member, two clip arms, and a securing member that extends in a direction generally perpendicular to that of the first clip arm and that is adapted to secure the clip to the fixed frame of a cabinet or set of drawers. The clip arms are each attached at one end to the mounting member and are designed to contact opposing surfaces of a movable member such as a door or drawer. The second clip arm will exert a force onto a movable member that is enough to secure the movable member against the first clip arm. The clip arms extend in a direction generally parallel to one another, thereby forming a gap between them. The gap has a portion that tapers from wide to narrow with increasing distance from the ends of the clip arms that are attached to the mounting member, and towards the free ends of the clip arms, the gap may also taper out again from narrow to wide to facilitate attachment and removal of the clip from a movable member. The clip may also include a shoulder on the mounting member on first clip arm that facilitates positioning the clip on a movable member so that the securing member will engage the fixed frame properly when the movable member is closed. The furniture clip provides an inexpensive and simple device that can be quickly and easily installed on cabinet doors or drawers and effectively restrains them in a closed position during shipment.

28 Claims, 2 Drawing Sheets

FURNITURE CLIP

FIELD OF THE INVENTION

The present invention relates generally to furniture and relates more particularly to a furniture clip used to secure a cabinet door or drawer in a closed position for shipping.

BACKGROUND OF THE INVENTION

The furniture industry has a long-standing problem with the manufacture of kitchen cabinets and similar products that have either doors hinged to the frame or drawers: the doors or drawers can open and become damaged during shipment. As they are often designed for home use, these types of cabinets typically have magnetic or mechanical catches that release easily. Because the catches ordinarily release easily, the doors tend to open if the cabinets are tipped or bumped during shipping, and the doors are frequently damaged by swinging open under their own weight or bumping into other objects.

The industry has tried numerous methods to prevent accidental opening during shipment, including tape, staples, and wire wrapped around the door and frame. None of these methods has given complete satisfaction, and indeed many can cause other types of damage to the cabinets such as sticky residue, holes, or scratches. Various mechanical locking devices have been developed, but these can be difficult to attach and detach, prohibitively expensive, or damaging to the cabinet in some way. In addition, these locking devices may not accommodate face plates of different thicknesses or doors with molding along the edges.

SUMMARY OF THE INVENTION

In view of the foregoing, it is an object of the present invention to provide an inexpensive and simple yet effective device that can be quickly and easily installed on cabinet doors or drawers to restrain the doors and drawers in a closed position during shipping.

It is another object of the present invention is to provide a single furniture door clip that can accommodate doors and drawers of different thicknesses and with molding along the edges.

It is also an object of the present invention to provide a furniture door clip that can be installed and removed with low risk of damage to the cabinet and that may be left on the cabinet to serve as an easily operable door lock.

These and other objects are satisfied by the present invention, which is directed to a clip for securing a movable member, such as a cabinet door or a drawer, to a fixed frame. The clip comprises a mounting member, two clip arms, and a securing member 10 that extends generally perpendicularly to the first clip arm and is adapted to secure the clip to the fixed frame. The clip arms each have respective fixed and free ends. The first clip arm connects at its fixed end to the mounting member and is designed to contact one surface of the movable member. The second clip arm connects at its fixed end to the mounting member and is designed to contact an opposing surface of the movable member.

The second clip arm may be arcuate, and it preferably extends in a direction generally parallel to the first clip arm. The first and second clip arms have a gap between them. The gap has a portion that tapers from wide to narrow with increasing distance from the fixed ends of the clip arms for a portion of the length of the arms. Towards the free ends of the clip arms, the gap may also taper out again from narrow to wide to facilitate attachment and removal of the clip from the movable member.

The clip may also include a shoulder on the mounting member or first clip arm that facilitates positioning the clip on the movable member so that the securing member will engage the fixed frame when the movable member is closed. The second clip arm should exert a force onto the movable member that is sufficient to secure the movable member against the first clip arm, but not so much that it prevents the easy attachment to or removal of the clip from the movable member, which typically has a thickness between ⅛ and 1 ¼ inches. The force exerted by the second clip arm upon the movable member when it is installed in place is preferably between 1, 2, 9 or 10 to 10, 20, 90 or 100 pounds (lbs.), depending upon the particular choice of material from which the clip is made, the specific thickness of the movable member, the particular configuration of the clip, etc. For example, in on embodiment the clip may exert a force of between 1 or 2 to 10 or 20 lbs; in another embodiment the clip may exert a force of between 9 or 10 to 90 or 100 lbs.

Ideally, the clip is formed of a polymeric material, and the securing member is barbed at its free end. A flange extends from the mounting location in a direction opposite that in which the first clip arm extends and contacts the fixed frame.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. In the figures, certain layers, elements, spacings, or regions may be exaggerated for clarity.

Figure 1:
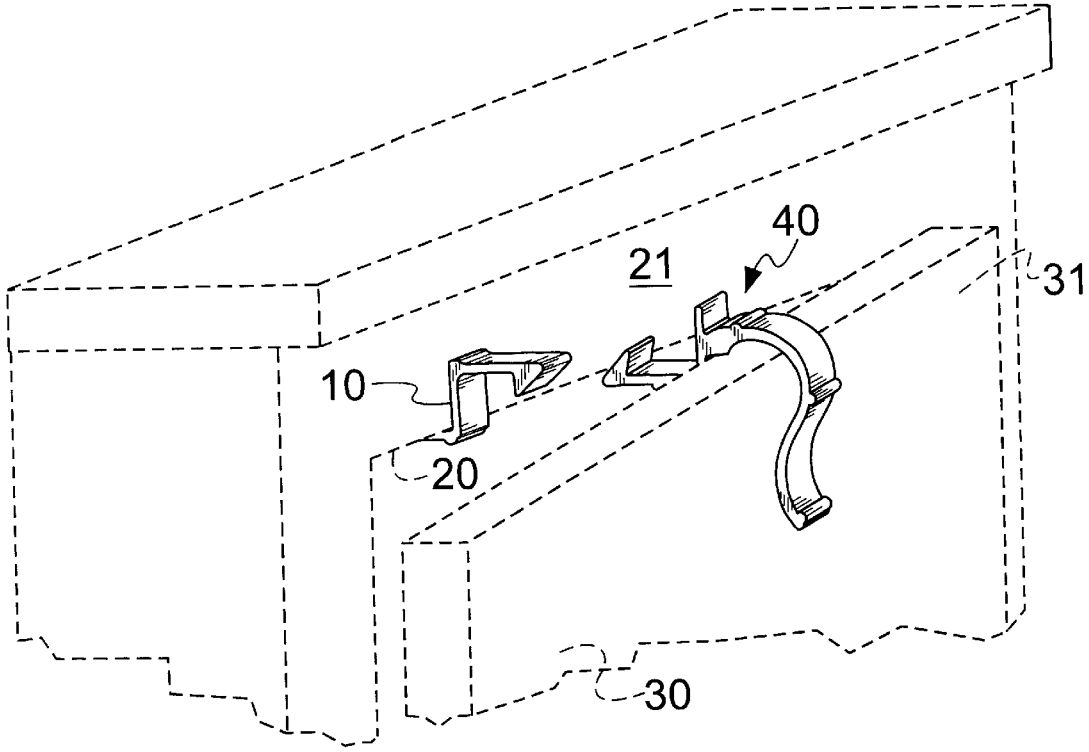
FIG. 1. is a perspective view of both a prior art furniture door clip and one embodiment of the present invention installed upon a cabinet door.
Figure 2:
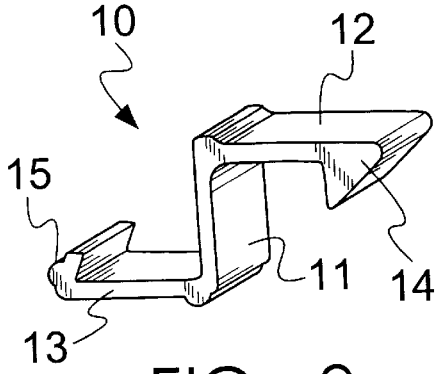
FIG. 2. is a perspective view of the prior art furniture door clip of FIG. 1.

A prior art furniture door clip is shown in FIGS. 1 and 2. As shown, the prior art clip 10 has a tripartite configuration, with a central transition member 11 and two securing members 12, 13 that are connected at the ends to the transition member 11 and extend generally perpendicularly therefrom. Each of the two securing members 12, 13 is barbed at its respective free end 14, 15.

In operation, as shown in FIG. 1, the prior art clip 10 fits below an edge 20 of the fixed frame 21 such the securing member 13 engages the fixed frame 21 and the securing member 14 extends generally outward toward the movable member 30. When the movable member 30 is closed, the securing member 12 engages the movable member 30 and maintains the door in the closed position.

Figure 3:
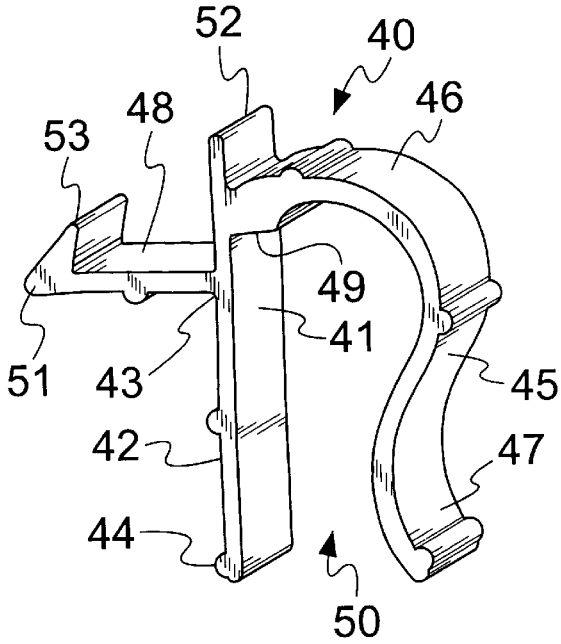
FIG. 3. is a perspective view of the embodiment of a furniture clip of the present invention FIG. 1.
Figure 4:
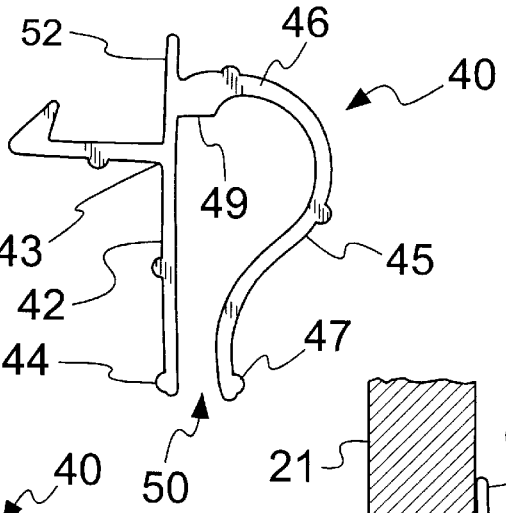
FIG. 4. is a side view of the furniture door clip of FIGS. 1 and 3.

A preferred embodiment of the instant invention is shown in FIG. 1 and 3–5. As shown, a furniture door clip 40 comprises a mounting member 41, a first clip arm 42 having a fixed end 43 and a free end 44, a second clip arm 45 having a fixed end 46 and a free end 47, and a securing member 48 extending generally perpendicularly to the first clip arm 42. The first clip arm 42 is connected at its fixed end 43 to the mounting member 41 and the second clip arm 45 is also connected at its fixed end 46 to the mounting member 41. The clip arms 42, 45 extend in a generally parallel direction A, as shown in FIG. 3, and define a gap 50 that tapers from wide to narrow with increasing distance from the fixed ends 43, 46 of the clip arms 42, 45 until close to the free ends 44, 47 of the clip arms 42, 45, at which point the gap 50 widens again.

Illustratively and preferably, the second clip arm 45 is arcuate, which allows the clip 40 to fit over molding at the edge of the movable member 30 and also allows the clip 40 to expand or contract to fit movable members 30 of different thicknesses. Alternatively, the second clip arm 45 could extend generally perpendicularly from the mounting member 41 and then angle sharply back toward the free end 44 of the first clip arm 42. This configuration would also allow the clip 40 to fit over molding at the edge of the movable member 30 and to expand or contract to fit movable members 30 of different thicknesses.

The illustrated embodiment also includes a shoulder 49 that is located on the mounting member 41 and is adapted to engage the movable member 30 to facilitate the relative positioning of the movable member 30 and the fixed frame 21. Alternatively, the clip 40 may be constructed with no shoulder 49, or an indistinguishable shoulder may be integrated into the second clip arm 45.

Preferably the clip 40 is formed of a polymeric material. The clip 40 may also be formed of a metal, wood, ceramic, or textile. If the clip 40 is formed of a nonpolymeric material, the clip arms 42, 45 and securing member 48 may be coated with a polymeric material to help prevent scratching. A particularly preferred polymeric material is high density polyethylene, because the self-lubricating properties thereof help prevent scratching or marring of the movable member when the clip is installed thereon.

In the preferred embodiment, the securing member 48 is barbed 53 at its free end 51. Instead of a barb 53, the securing member 48 may terminate in a hook or an angular extension.

Preferably, a flange 52 adapted to contact the fixed frame 21 extends from the mounting member 41 in a direction opposite that in which the first clip arm 42 extends. The purpose of the flange 52 is to brace against the frame and help facilitate clamping.

Alternatively, the clip 40 could be designed without a flange 52, or the flange function could be integrated into the design of one of the clip arms 42, 45.

Figure 5:
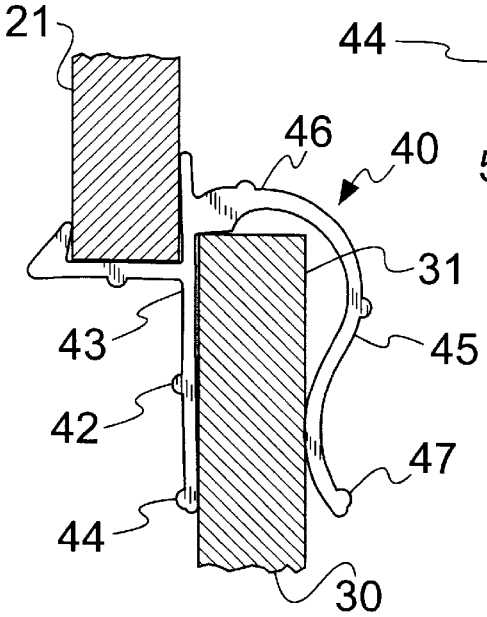
FIG. 5. is a side section view of the clip of FIG. 3 installed on a cabinet door with the door in the closed position.
Figure 6:
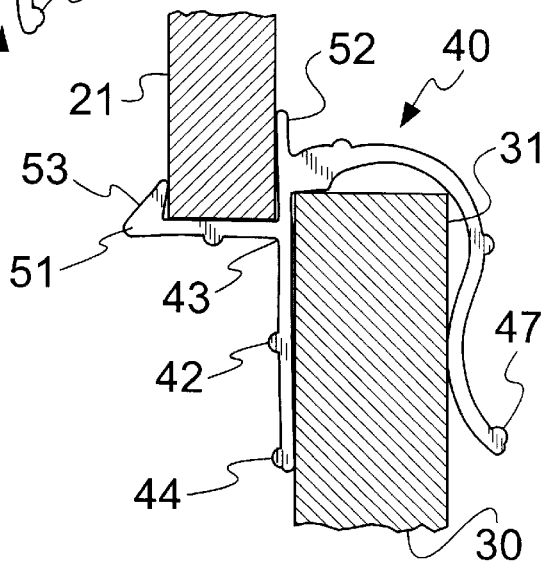
FIG. 6. is a side section view of the clip of FIG. 3 installed on a cabinet door, thicker than the door shown in FIG. 5, with the door in the closed position.
Figure 7:
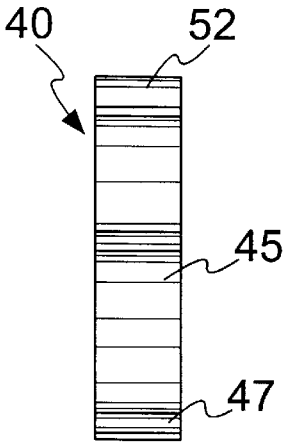
FIG. 7. is a front view of a furniture clip of the invention.
Figure 8:
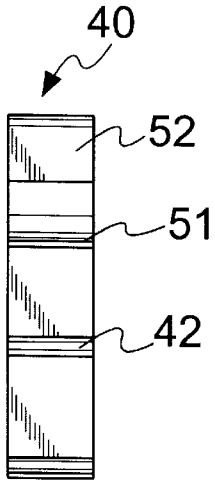
FIG. 8. is a back view of a furniture clip of the invention.
Figure 9:
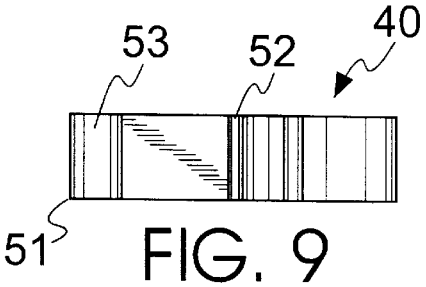
FIG. 9. is a top view of a furniture clip of the invention.
Figure 10:
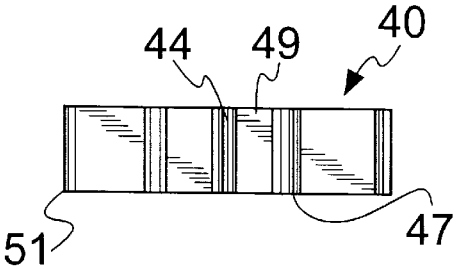
FIG. 10. is a bottom view of a furniture clip of the invention.

In operation, the clip arms 42, 45 fit over a door 30, engaging the shoulder 49 at the top edge of the door 30. (FIGS. 1 and 5) The shoulder 49 positions the clip 40 properly in relation to the movable member 30 and the fixed frame 21. The deflection of the second clip arm 45 required to receive the door 30 causes the exertion of a force on the door 30 that secures the door 30 against the first clip arm 42. As the door 30 is closed, the securing member 48 is pressed against an edge 20 of the fixed frame 21. As shown in FIG. 5, once the barb 53 at the free end 51 of the securing member 48 passes beyond and engages the fixed frame 21, the door 30 is held in a closed position against the fixed frame 21. Meanwhile, the flange 52 contacts a surface of the fixed frame 21 and prevents a light force on the second clip arm 45 from disengaging the barbed securing member 48. As shown in FIG. 5 and FIG. 6, an advantage of the present invention is that a single clip of the invention may be used on doors of differing thickness, whether or not those doors have an outer bead, molding or other raised portion along the outer edge 31 thereof.

The present invention has several distinct advantages over the prior art. A single size of the clip 40 is able to accommodate face plates 21, 30 of various thicknesses. In addition, the clip 40 can accommodate cabinet doors 30 with molding around the edge. The clip 40 can be made inexpensively, installed relatively quickly and easily, and is unlikely to damage furniture. The flange 52 prevents the clip from being disengaged by a light force on the second clip arm 45. Another advantage is that without changing the design at all, the clip 40 can be used not only for cabinet doors but also for drawers.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A clip for securing a movable member to a fixed frame, said clip being a unitary member formed of a polymeric material and comprising:

a mounting member including a shoulder;

first and second clip arms having respective fixed and free ends;

said first clip arm connected at said fixed end to said mounting member and adapted to contact a first inner surface of said movable member;

said second clip arm connected at said fixed end to said mounting member and adapted to contact a second surface of said movable member, said first and second arms defining a gap, said gap having a portion tapering from wide to narrow with increasing distance from said fixed ends of said clip arms; and a securing member extending generally perpendicularly to said first clip arm and adapted to secure said clip to said fixed frame;

the shoulder facing the gap and adapted to engage the movable member to facilitate the relative positioning of the movable member and the frame.

2. A clip according to claim 1, wherein said gap has a major portion tapering from wide to narrow with increasing distance from said fixed ends of said clip arms.

3. A clip according to claim 1, wherein said first and second clip arms extend in a generally parallel direction.

4. A clip according to claim 1, wherein said second clip arm is arcuate.

5. A clip according to claim 1, wherein said gap has an end portion tapering from narrow to wide approaching said free ends of said clip arms.

6. A clip according to claim 1, wherein said second clip arm exerts a force to secure said movable member against said first clip arm while still allowing said clip to be easily inserted onto or removed from said movable member where said movable member has a thickness between ⅛ and 1 ¼ inches.

7. A clip according to claim 6, wherein said second clip arm exerts a force of between 1 and 100 lbs. on said movable member.

8. A clip according to claim 1, wherein said clip is formed of a polymeric material.

9. A cabinet in condition for shipping, comprising:

a fixed frame;

a movable member configured to separate from said fixed frame; and a clip, wherein said clip is a unitary member formed of a polymeric material and comprises:

a mounting member;

first and second clip arms having respective fixed and free ends, said first clip arm connected at said fixed end to said mounting member and contacting a first inner surface of said movable member, said second clip arm connected at said fixed end to said mounting member and contacting a second opposed surface of said movable member, said first and second clip arms defining a gap, said gap having a portion tapering from wide to narrow at increasing distance from said fixed ends of said clip arms; and a securing member extending generally perpendicularly to said first clip arm and securing said clip to said fixed frame.

10. A cabinet in condition for shipping according to claim 9, wherein said gap has a major portion tapering from wide to narrow with increasing distance from said fixed ends of said clip arms.

11. A cabinet in condition for shipping according to claim 9, wherein said first and second clip arms extend in a generally parallel direction.

12. A cabinet in condition for shipping according to claim 9, wherein said mounting member includes a shoulder facing said gap and adapted to engage said movable member to facilitate the relative positioning of said movable member and said fixed frame.

13. A cabinet in condition for shipping according to claim 9, wherein said second clip arm is arcuate.

14. A cabinet in condition for shipping according to claim 9, wherein said gap has an end portion tapering from narrow to wide approaching said free ends of said clip arms.

15. A clip according to claim 14, wherein said second clip arm exerts a force of between 1 and 100 lbs. on said movable member.

16. A cabinet in condition for shipping according to claim 9, wherein said second clip arm secures said movable member against said first clip arm while still allowing said clip to be easily inserted onto or removed from said movable member where said movable member has a thickness between ⅛ and 1 ¼ inches.

17. A cabinet in condition for shipping according to claim 9, wherein said securing member is barbed at a free end thereof.

18. A cabinet in condition for shipping according to claim 9, wherein a flange extends from said mounting member in a direction opposite that in which said first clip arm extends and contacts said fixed frame.

19. A cabinet in condition for shipping according to claim 9, wherein said movable member is a door.

20. A cabinet in condition for shipping according to claim 9, wherein said movable member is a drawer.

21. A clip according to claim 9, wherein a flap extends from said mounting member in a direction opposite that in which said first clip arm extends and is adapted to contact the first inner surface of said movable member as is said first clip arm.

22. A clip for securing a movable member to a fixed frame, the clip being a unitary member formed of a polymeric material and comprising:

a mounting member;

first and second clip arms having respective fixed and free ends, wherein said first and second clip arms extend in a generally parallel direction, and wherein said second clip arm is arcuate;

said first clip arm connected at said fixed end to said mounting member and adapted to contact a first inner surface of said movable member;

said second clip arm connected at said fixed end to said mounting member and adapted to contact a second surface of said movable member, said first and second clip arms defining a gap, said gap having a portion tapering from wide to narrow with increasing distance from said fixed ends of said clip arms, and wherein said gap has a major portion tapering from wide to narrow with increasing distance from said fixed ends of said clip arms; and a securing member extending generally perpendicularly to said first clip arm and adapted to secure said clip to said fixed frame.

23. A clip according to claim 23, wherein said gap has an end portion tapering from narrow to wide approaching said free ends of said clip arms.

24. A clip according to claim 22, wherein said second clip arm exerts a force to secure said movable member against said first clip arm while still allowing said clip to be easily inserted onto or removed from said movable member where said movable member has a thickness between ⅛ and 1¼ inches.

25. A clip according to claim 24, wherein said second clip arm exerts a force of between 1 and 100 lbs. on said movable member.

26. A clip according to claim 26, wherein said securing member is barbed at a free end thereof.

27. A clip for securing a movable member to a fixed frame, said clip being a unitary member formed of a polymeric material and comprising:

a mounting member;

first and second clip arms having respective fixed and free ends;

said first clip arm connected at said fixed end to said mounting member and adapted to contact a first inner surface of said movable member;

said second clip arm with an arcuate profile connected at said fixed end to said mounting member and adapted to contact a second surface of said movable member, said first and second clip arms defining a gap, said gap having a portion tapering from wide to narrow with increasing distance from said fixed ends of said clip arms;

a shoulder positioned between the second clip arm and the mounting member configured to engage the top surface of the movable member; and a securing member extending generally perpendicularly to said first clip arm and adapted to secure said clip to said fixed frame.

28. A clip for securing a movable member to a fixed frame, said clip being a unitary member formed of a polymeric material and comprising:

a mounting member;

first and second clip arms having respective fixed and free ends;

said first clip arm connected at said fixed end to said mounting member and adapted to contact a first inner surface of said movable member;

said second clip arm connected at said fixed end to said mounting member and adapted to contact a second surface of said movable member, said first and second clip arms defining a gap, said gap having a portion tapering from wide to narrow with increasing distance from said fixed ends of said clip arms; and a securing member extending generally perpendicularly to said first clip arm and adapted to secure said clip to said fixed frame;

wherein a flange extends from the mounting member in a direction opposite that in which the first clip arm extends and is adapted to contact the fixed frame.

* * * * *

UNITED STATES PATENT AND TRADEMARK OFFICE

CERTIFICATE OF CORRECTION

PATENT NO. : 6,481,811 B1
DATED : November 19, 2002
INVENTOR(S) : Thomas R. Marsh It is certified that error appears in the above-identified patent and that said Letters Patent is hereby corrected as shown below:

Column 4,
Line 59, please insert -- clip -- before the word “arms”.

Column 6,
Lines 43 and 54, please delete “claim 23” and insert -- claim 22 --.

Signed and Sealed this

Sixth Day of May, 2003

JAMES E. ROGAN
*Director of the United States Patent and Trademark Office*